US006106765A

United States Patent [19]

Lee et al.

[11] Patent Number: 6,106,765

[45] Date of Patent: Aug. 22, 2000

[54] PURIFICATION PROCESS FOR CHROMIUM

[75] Inventors: Young Lee, Washington; Stephen Houser, Vienna; Gregory Noland, Parkersburg, all of W. Va.; Andrew Arnold, Fleming, Ohio

[73] Assignee: Eramet Marietta Inc., Marietta, Ohio

[21] Appl. No.: 09/436,813

[22] Filed: Nov. 9, 1999

Related U.S. Application Data

[63] Continuation of application No. PCT/US99/17426, Jul. 29, 1999, which is a continuation-in-part of application No. 09/130,055, Aug. 6, 1998, abandoned.

[51] Int. Cl.[7] ..... B22F 3/24

[52] U.S. Cl. ..... 419/29; 419/38; 148/423

[58] Field of Search ..... 419/38, 29; 148/423

[56] References Cited

U.S. PATENT DOCUMENTS

| | | | |
|---|---|---|---|
| 2,939,784 | 6/1960 | Brennan et al. . | |
| 4,504,310 | 3/1985 | Boulier | 75/27 |
| 5,092,921 | 3/1992 | Kobayashi et al. | 75/623 |

FOREIGN PATENT DOCUMENTS

| | | |
|---|---|---|
| 62-047435 | 3/1987 | Japan . |
| 63-161101 | 7/1988 | Japan . |
| 63-199832 | 8/1988 | Japan . |
| 63-282217 | 11/1988 | Japan . |
| 2255349 | 4/1992 | United Kingdom . |

*Primary Examiner*—Daniel J. Jenkins
*Attorney, Agent, or Firm*—Bierman, Muserlian and Lucas

[57] ABSTRACT

Purification process for chromium metal is conducted on chromium metal powder which has been compacted without additives at a pressure of at least 50,000 psi ($35\times10^7$ Pa) into a compacted body having a critical diffusion dimension of less than or equal to 25 mm. The purification process uses a hydrogen gas treatment at a temperature of 1200° C. to 1600° C. for a period of 2 hours to 10 hours using 0.8 $m^3$ per Kg chromium metal of hydrogen gas or more. The hydrogen treated chromium metal compacted body is then further treated under vacuum at a pressure less than or equal to 100 $\mu$m of Hg (15 Pa) at 1200° C. to 1600° C. for 2 hours to 10 hours. The combined hydrogen and vacuum treatment reduces the oxygen, carbon, sulfur and nitrogen impurities in the chromium metal and results in a chromium metal suitable for metallurgical and electronic applications.

20 Claims, No Drawings

PURIFICATION PROCESS FOR CHROMIUM

CROSS-REFERENCE TO RELATED APPLICATIONS

This application is a continuation of International Application No. PCT/US99/17426 filed Jul. 29, 1999 which, in turn, was a continuation-in-part of U.S. patent application Ser. No. 09/130,055 filed Aug. 6, 1998, now abandoned.

BACKGROUND OF THE INVENTION

1. Field of the Invention

The process of the present invention is directed to purifying raw chromium metal which has been obtained from an electrolytic, aluminothermic, or other pyrometallurgical processes. The process of the present invention treats the raw chromium metal with hydrogen gas and a vacuum at elevated temperatures to reduce the carbon (C), nitrogen (N), oxygen (O) and sulfur (S) content of the chromium metal. The purified chromium metal is suitable for metallurgical and electronic applications which demand chromium metal with low gaseous impurities.

2. Description of Related Art

Raw chromium metal is prepared through either an electrolytic process, an aluminothermic process, or other pyrometallurgical processes. Electrolytically prepared chromium metal is obtained as plates, and has a gaseous impurity content typically of 0.006 wt % C, 0.5 wt % O, 0.03 wt % N, and 0.03 wt % S. Aluminothermically produced chromium metal is produced as lumpy masses and, subsequently, ground into smaller sizes. The contents of gaseous impurities in the aluminothermically produced chromium metal vary depending on the raw materials mix order and on the sample positions in the reactors. A typical impurity analysis of the aluminothermically produced and degasifying-grade chromium metal is 0.03 wt % C, 0.5 wt % O, 0.05 wt % N, and 0.02 wt % S. Other pyrometallurgical processes which produce a raw chromium metal are the carbothermic reduction of chromium oxide or chromium oxyhydroxide under a vacuum. Again, the chemistry of the raw chromium metal obtained by these two processes vary depending on the mix order and processing conditions. Usually, the impurity analyses of carbon and oxygen show a greater variance than the other processes. The impurity contents of carbon and oxygen for the degasifying-grade chromium metal made by carbothermic reduction are in the range of 0.01 to 0.3 wt % C and 0.03 to 0.35 wt % O when chromium oxyhydroxide is used, and 0.89 to 1.76 wt % C and 1.18 to 1.71 wt % O when chromium oxide is used. In all cases, the raw chromium metal typically has a chromium content of about 99.1 wt %.

Some critical metallurgical applications for chromium metal, such as turbine engine parts, demand a low content of the gaseous impurities in chromium metal. The contents of the gaseous impurities in the chromium metals prepared by electrolytic, aluminothermical, or other pyrometallurgical processes are too high for critical metallurgical applications, and raw chromium metals need to be refined to lower these impurities to the level less than 0.003 wt % C, 0.03 wt % O, 0.002 wt % N, and 0.001 wt % S.

The conventional refining process of raw chromium metal uses powdered chromium metal in order to minimize the reaction time. The chromium metal powders are, however, agglomerated into pellets or briquettes for efficient handling during the refining process. Binders are usually added in order to provide a green strength to the pellets or briquettes.

Other reactants are also added to the powder at the time of briquetting to achieve the intended refining reactions. For example, carbon is added to remove the oxygen; and tin, nickel, copper, or mercury is added to remove the sulfur.

The conventional refining process treats the pellets or briquettes at 1100° C. to 1500° C. under a vacuum in order to control the residual contents of C, O, N, and S. See U.S. Pat. No. 5,092,921.

One of the problems associated with the conventional refining process is that the final chemistry of the refined chromium metal depends on the precise control of the stoichiometric relationships of the added reactants, quality of the blending, and the conditions of the refining reactions. Often, problems occur in that the added reactants in the agglomeration suffers an inevitable weighing error, the blending of the ingredient mixes is insufficient, and/or the processing variable for the refining reactions are not controlled well. As a result, the chemistry of the final products can be inconsistent.

A variation of the conventional process is to forego the addition of desulfurizing agents. See U.S. Pat. No. 4,504,310 and GB 2,255,349A. Such a process, however, does not control the sulfur content.

There is a need for a commercially viable process which controls the gaseous elements of C, O, N, and S together, and produces consistent results.

SUMMARY OF THE INVENTION

A process has now been discovered for purifying a raw chromium metal obtained from either the electrolytic, aluminothermic, or other pyrometallurgical reduction processes which avoids the use of added reducing agents, desulfurizing agents and/or binder. The process of the present invention employs raw chromium metal without any additives. The process of the present invention comprises treating a raw chromium metal with hydrogen gas and vacuum to produce a purified chromium metal. The residual content of oxygen and sulfur in the purified chromium metal is controlled by the amount of hydrogen gas and the temperature during the hydrogen gas treatment step, while the amount of residual nitrogen in the purified chromium metal is controlled by the degree of vacuum and the temperature during the vacuum step. The process of the present invention has been shown to produce consistent uniform results.

Broadly, the process of the present invention comprises treating raw chromium metal with hydrogen gas in an amount greater than or equal to about 0.8 $m^3$ per Kg of chromium metal at a temperature of about 1200° C. to about 1600° C., for a period of about 2 hours to about 10 hours; and treating said chromium metal with a vacuum at a pressure less than or equal to about 100 $\mu$m of mercury (15 Pa) at a temperature of about 1200° C. to about 1600° C., for a period of about 2 hours to about 60 hours. The chromium metal treated by the two treatment steps is then cooled and recovered as a purified chromium metal.

The order of the hydrogen and vacuum treatment steps does not matter, however, it is preferred to first treat the raw chromium metal with hydrogen and subsequently treat with a vacuum.

The process of the present invention can be conducted on raw chromium metal powders, compacted bodies of raw chromium metal powder formed without a binder or other additives, or raw chromium metal flakes. It has been found that the process of the present invention is best conducted on compacted bodies of chromium metal powder which contains no binder or other additive.

The present invention has been found to produce a high purity chromium metal which contains low residual carbon, oxygen, nitrogen and sulfur. The purified chromium metal of the present invention has been found to have a composition of better than 99 wt % chromium, less than 0.003 wt % carbon, less than 0.001 wt % sulfur, less than 0.03 wt % oxygen, and less than 0.002 wt % nitrogen. All these percentages are based on the weight of the purified chromium metal. It has also been found that the purification process of the present invention produces consistent chemistry in the final product. More specifically, the purified chromium metal has a chromium content of about 99.5 wt % and above, and, more preferably, about 99.7 wt % and above.

DETAILED DESCRIPTION OF THE INVENTION

The raw chromium metal which is subject to a purification process is either in powdered form, flake form, or compacted form. Raw chromium metal which is produced by an electrolytic, aluminothermic or other pyrometallurgical process is usually prepared in the form of a powder.

In powdered form, the chromium metal powder preferably has a particle size of less than about 0.5 mm (32 M×D) and, more preferably, a particle size of less than about 0.25 mm (60 M×D). If treated, the powder must be contained in inert vessels in order to facilitate handling. The critical diffusion dimension for uniform chemistry (e.g. thickness of the metal powder in the bed in the vessels) is preferably less than or equal to about 25 mm.

When the metal is the form of a flake, it is preferred that the flake have a thickness of less than about 0.5 mm.

In compacted form, the compacted body has a critical diffusion dimension of less than or equal to about 25 mm and, more preferably, less than or equal to about 22 mm. The compacted body can take any form, such as a pellet, briquette or tablet. The actual shape does not matter, provided the critical diffusion dimension limitation is met. The chromium metal powder is compacted with no binder or other additive being employed. The preferred powders used for compacting are those listed above.

Compacting is conducted by employing a mechanical force to press the powder without additives into a compacted body in a conventional manner using conventional equipment. The pressure employed during compacting is greater than or equal to about 50,000 psi ($35\times10^7$ Pa) and, more preferably, greater than or equal to about 80,000 psi ($55\times10^7$ Pa). The compacting produces a compacted body (green pellet) which has an apparent density of about 4.8 grams/$cm^3$ and which has sufficient strength to withstand handling during treatment. Hydrogen gas and the reaction products, water vapor and hydrogen sulfide, need to diffuse through pores of the compacted body during the process of the present invention. The nature of the diffusive migration affects the reaction rate and the variability in the chemistry. A shorter diffusion distance through a compacted body favors a shorter reaction time and a smaller variability in the chemistry. Therefore, the size and shape of the compacted body needs to have the critical diffusion dimension as short as practically possible. For a disc-shaped compacted body, the thickness of the compacted body is shorter than the diameter and the thickness becomes the critical diffusion dimension. For a cylindrical shaped compacted body, the diameter is shorter than the length and the diameter becomes the critical diffusion dimension. It is preferred to prepare the compacted body in the disc form with the thickness less than about 25 mm, preferably less than about 22 mm; and with the diameter greater than about 25 mm, preferably about 40 mm. It has been found that if the size of the compacted body is excessive, the chemistry throughout the compacted body becomes non-uniform. If it is too small in size, the compacted body suffers poor productivity. Thus, the critical diffusion dimension is the shortest distance across the compacted body.

Hydrogen treatment is conducted in a conventional manner using conventional equipment. The temperature during the hydrogen treatment is about 1200 to about 1600° C., more preferably, about 1450° C. to about 1550° C., and most preferred about 1500° C. The time for the hydrogen treatment is about 2 to about 10 hours and, more preferably, about 4 to about 6 hours. The amount of hydrogen gas used during the treatment varies depending on the temperature. The amount of hydrogen gas is greater than or equal to about 0.8 $m^3$ per Kg of chromium metal treated and, more preferably, greater than or equal to about 1.3 $m^3$ per Kg chromium metal treated. These values are best employed at about 1500° C. Good results have been found by employing hydrogen gas in an amount of about 2.6 $m^3$ per Kg of compacted bodies at a temperature of about 1500°C. for a period of about 5 hours.

It has been found that hydrogen reacts more efficiently with sulfur than with oxygen, and the hydrogen refining condition can be defined with the reaction with the oxygen in chromium metal. Oxygen in the raw chromium metal is associated as chromium oxide, $Cr_2O_3$, and the refining reaction with hydrogen is governed as follows:

$$Cr_2O_3+3H_2=2Cr+3H_2O,\ \Delta G^\circ(\text{cal.})=94{,}123-21.849T(K)$$

$$K=[P_{H2O}/P_{H2}]^3,\ P_{H2}/P_{H2O}=1/K^{1/3}$$

This shows that the hydrogen in the gas phase needs to be maintained at higher values than the ratio defined in the above governing equation. The ratio of $PH_2$ to $PH_2O$ is calculated and shown in the following at various temperatures.

| Temperature (° C.) | $PH_2/PH_2O$ |
|---|---|
| 1200 | 1157.58 |
| 1250 | 814.58 |
| 1300 | 585.60 |
| 1350 | 429.85 |
| 1400 | 321.40 |
| 1450 | 244.40 |
| 1500 | 188.74 |
| 1600 | 117.32 |

This indicates that the amount of hydrogen gas for the treatment becomes less as the temperature increases. If the temperature is too low, the amount of hydrogen gas for treating chromium metal becomes too excessive for the process to be economical. If the temperature is too high, the required amount of hydrogen gas is small but the loss of chromium as a vapor becomes significant. Hence, it is preferred the temperature for the hydrogen refining be in the range of 1400° C. to 1600° C., more preferably 1500° C.

The equilibrium amount of hydrogen gas to treat raw chromium metal is 1.3 $m^3$ per kilogram of chromium metal at the initial of 0.5 wt % at 1500° C. An excess amount of the hydrogen above the equilibrium value assures a consistent result.

The hydrogen gas treatment is conducted in a conventional manner using conventional equipment. A container holds the compacted bodies and hydrogen gas is supplied by hydrogen supply tanks to the container. The container has means to heat the interior volume of the container.

Vacuum treatment is conducted in a conventional manner using conventional equipment. The vacuum treatment is conducted at a pressure of less than or equal to about 100 $\mu$m of mercury (15 Pa) and, more preferably, at less than or equal to about 10 $\mu$m of mercury (1.5 Pa). The temperature during the vacuum treatment is about 1200° C. to about 1600° C. and, more preferably, about 1400° C. The time for vacuum treatment is about 2 to about 60 hours and, more preferably, about 4 to about 6 hours. When the chromium metal is in powder form, necessary steps must be taken to prevent the powder from being sucked into the vacuum piping used to evacuate the vacuum treatment chamber.

Preferably, the hydrogen treatment is conducted first and then the vacuum treatment. The hydrogen treatment reduces both the oxygen and sulfur impurities within the chromium metal, while the vacuum treatment step reduces the nitrogen content of chromium metal. The two treatments, however, can be reversed such that the vacuum treatment is conducted first to remove the nitrogen and then the hydrogen treatment conducted so as to remove the oxygen and sulfur from the chromium metal.

After the treatments, the chromium metal is cooled under an inert gas atmosphere or under vacuum. Suitable inert gases for use during cooling include helium, argon, and hydrogen gas. The preferred gas for use during cooling is hydrogen gas. Cooling is conducted using conventional equipment in a conventional manner.

Preferably, the chromium metal is heated, then treated by hydrogen and vacuum while maintaining the temperature, followed by a cooling step. The preferred steps of the present invention, heating—hydrogen treatment—vacuum treatment—cooling, can be conducted in a batch or continuous mode. The batch mode of the operation can perform the steps in a single vessel. The continuous mode can carry out the steps in sequence through specialized compartments or vessels. Continuous processes are generally more economical to operate and are preferred.

The preferred order of steps for the present invention is first, compacting a chromium metal powder; next, the compacted chromium metal powder is heated and treated with hydrogen gas; and then the hydrogen gas treated compacted chromium metal powder is treated in a vacuum while maintaining the temperature of the compacted chromium metal powder during the treatment steps. Finally, after vacuum treatment, the compacted chromium metal powder is cooled and recovered.

These and other aspects of the present invention may be more fully understood by reference to one or more of the following examples.

EXAMPLE 1

This example illustrates forming compacted bodies having different dimensions from a chromium metal powder and treating them with hydrogen gas to reduce the oxygen and sulfur.

Raw chromium metal powder (0.25 mm, 60 M×D) was compacted into disc-shaped bodies with a compacting force of 56,000 psi ($39\times10^7$ Pa) without additives. The raw chromium metal powder had an impurity content of 0.006 wt % C, 0.5 wt % O, 0.03 wt % N, and 0.03 wt % S.

Three different disc-shaped compacted bodies were formed, each having a diameter of 31 mm. The three had different thicknesses (critical diffusion dimension) of 12.7, 19, and 25.4 mm. They were each treated at 1450° C. for 4 hours under hydrogen gas at a flow rate of 1600 and 1860 cc/min. No vacuum treatment step was performed.

The performance of the hydrogen treatment was evaluated by measuring the residual oxygen and sulfur contents in the refined chromium metal. The results were as follows:

TABLE I

| | | After Processing | |
|---|---|---|---|
| Thickness of Body (mm) | $H_2$ Flow Rate (cc/min) | wt % O | wt % S |
| 12.7 | 1600 | 0.023 | 0.0006 |
| 12.7 | 1860 | 0.022 | 0.0004 |
| 19 | 1600 | 0.032 | 0.0003 |
| 25.4 | 1860 | 0.050 | 0.0003 |

As can be seen, the residual sulfur content is less than 0.001 wt % regardless of the thickness of the body. The residual oxygen content is shown to increase with the thickness of the body. The oxygen content of 0.05 wt % or less can be obtained by maintaining the thickness less than 25.4 mm.

EXAMPLE 2

This Example illustrates forming compacted bodies from a chromium metal powder and treating them with different amounts of hydrogen gas to reduce the oxygen and sulfur.

Raw chromium metal powder, same as used in Example 1, was compacted into disc-shaped compacted bodies with a compacting force of 80,000 psi ($55\times10^7$ Pa) without additives. The bodies were prepared in a tablet form, 32 mm diameter, 22 mm thick at the center of the tablet, and 11 mm thick at the edge of the tablet. The critical diffusion dimension being 22 mm.

The tablets were treated at 1450° C. for 4 hours and with various hydrogen gas amounts. No vacuum treatment step was performed.

The performance was evaluated by measuring the residual oxygen and sulfur contents in the refined chromium metal. The results were as follows:

TABLE II

| | After Processing | |
|---|---|---|
| Amount of $H_2$ gas, $m^3$/kg Cr | wt % O | wt % S |
| 1.52 | 0.0547 | 0.0003 |
| 1.83 | 0.0387 | 0.0004 |
| 2.43 | 0.0417 | 0.0003 |
| 3.04 | 0.035 | 0.0004 |
| 5.17 | 0.0233 | 0.0005 |

As can be seen, the residual sulfur content is less than 0.001 wt % in each case. The residual oxygen content decreases with the increased amount of the hydrogen gas but decreases slowly at the amount higher than the value at the equilibrium, 1.7 $m^3$ per kilogram chromium. It indicates that the residual oxygen content becomes less than 0.05 wt % at the hydrogen gas amount higher than 1.7 $m^3$ per kilogram chromium.

EXAMPLE 3

This Example illustrates the results obtained from the combined hydrogen and vacuum treatment steps of the present invention. It also illustrates the uniformity obtained by the present invention within a single batch.

Raw chromium metal powder, the same as used in Example 1, was compacted into tablets with a compacting force of 80,000 psi ($55\times10^7$ Pa) without additives. The tablets had a diameter of 32 mm, were 22 mm thick at the center, and were 11 mm thick at the edge. The critical diffusion dimension was 22 mm.

These tablets were treated first with hydrogen gas at the rate of 2.8 $m^3$ per Kg of chromium metal at a temperature of 1450° C. for a period of 5 hours. Subsequently, five tablets were treated under a vacuum of 15 to 40 $\mu$m of mercury (2 to 5.3 Pa) at a temperature of 1450° C. for a period of 60 hours. After cooling under vacuum, each tablet was analyzed for carbon, oxygen, nitrogen, and sulfur. The results were as follows:

TABLE III

| | After Processing | | | |
|---|---|---|---|---|
| Compacted Bodies | wt % C | wt % O | wt % N | wt % S |
| 1 | 0.0025 | 0.022 | 0.0015 | 0.0008 |
| 2 | 0.0025 | 0.020 | 0.0015 | 0.0006 |
| 3 | 0.0028 | 0.023 | 0.0013 | 0.0006 |
| 4 | 0.0032 | 0.018 | 0.0016 | 0.0007 |
| 5 | 0.0020 | 0.024 | 0.0020 | 0.0008 |

As can be seen, the residual contents of carbon, oxygen, nitrogen, and sulfur are less than 0.003 wt % C, 0.03 wt % O, 0.002 wt % N, and 0.001 wt % S.

EXAMPLE 4

This Example illustrates the results obtained from the hydrogen treatment step of the present invention at a higher temperature than that of Example 3. It also illustrates the uniformity obtained by the present invention within a single batch.

Raw chromium metal powder, the same as used in Example 1, was compacted into tablets with a compacting force of 80,000 psi ($55\times10^7$ Pa) without additives. The tablets had a diameter of 32 mm, were 22 mm thick at the center, and were 11 mm thick at the edge. The critical diffusion dimension was 22 mm.

These tablets were treated first with hydrogen gas at the rate of 2.57 $m^3$ per Kg of chromium metal for a period of 5 hours. The temperataure was increased stepwise at 25° C. increments per hour from 1450° C. to 1550° C. After cooling under hydrogen, each tablet was analyzed for carbon, oxygen, nitrogen, and sulfur. The results were as follows:

TABLE IV

| | After Processing | | | |
|---|---|---|---|---|
| Compacted Bodies | wt % C | wt % O | wt % N | wt % S |
| 1 | 0.0026 | 0.02 | 0.0067 | 0.0007 |
| 2 | 0.0027 | 0.017 | 0.0042 | 0.0006 |
| 3 | 0.0029 | 0.018 | 0.0032 | 0.0007 |

As can be seen, the residual contents of carbon, oxygen, and sulfar are less than 0.003 wt % C, 0.03 wt % O, and 0.001 wt % S.

It will be understood that the claims are intended to cover all changes and modifications of the preferred embodiments of the invention herein chosen for purposes of illustration which do not constitute a departure from the spirit and scope of the invention.

What is claimed is:

1. A process for purifying a chromium metal obtained from an electrolytic, aluminothermic, or a pyrometallurgical reduction process comprising:

treating said chromium metal with hydrogen gas in an amount greater than or equal to about 0.8 $m^3$ per Kg of chromium metal, at a temperature of about 1200° C. to about 1600° C., for a period of about 2 hours to about 10 hours;

treating said chromium metal in a vacuum at a pressure less than or equal to about 100 $\mu$m of Hg (15 Pa), at a temperature of about 1200° C. to about 1600° C., for a period of about 2 hours to about 60 hours; and cooling and recovering a purified chromium metal.

2. The process of claim 1 wherein the hydrogen treatment is conducted at about 1500° C.

3. The process of claim 1 wherein the hydrogen treatment is conducted for about 4 to about 6 hours.

4. The process of claim 1 wherein the hydrogen treatment is conducted with about 2.6 $m^3$ per Kg chromium metal of hydrogen gas.

5. The process of claim 1 wherein the vacuum treatment is conducted at about 1400° C.

6. The process of claim 1 wherein the vacuum treatment is conducted for about 4 to about 6 hours.

7. The process of claim 1 wherein the vacuum treatment is conducted at less than or equal to about 10 $\mu$m of Hg (1.5 Pa).

8. The process of claim 1 wherein said hydrogen treatment is conducted before said vacuum treatment.

9. The process of claim 1 wherein said vacuum treatment is conducted before said hydrogen treatment.

10. The process of claim 1 wherein the chromium metal is in the form of a compacted body without additives having a critical diffusion dimension of less than or equal to about 25 mm.

11. The process of claim 1 wherein the chromium metal is in the form of a powder having a particle size of less than or equal to about 0.5 mm.

12. The process of claim 1 wherein the chromium metal is in the form of a flake having a thickness less than or equal to about 0.5 mm.

13. The process of claim 1 wherein said process further comprises compacting a chromium metal powder without additives to form a compacted body prior to said treatments, said compacting being conducted at a pressure of greater than or equal to about 50,000 psi ($35\times10^7$ Pa) to form a compacted body having a critical diffusion dimension of less than or equal to 25 mm.

14. The process of claim 13 wherein the compacting is conducted at about 80,000 psi ($55\times10^7$ Pa).

15. The process of claim 13 wherein the compacted body has a critical diffusion dimension less than or equal to about 22 mm.

16. A process for purifying a chromium metal obtained from an electrolytic, aluminothermic, or a pyrometallurgical reduction process comprising:

compacting a chromium metal powder without additives in a pelletizer at a pressure greater than or equal to about 50,000 psi ($35\times10^7$ Pa) to form a compacted body having a critical diffusion dimension of less than or equal to about 25 mm;

treating said compacted body with hydrogen gas in an amount greater than or equal to about 0.8 $m^3$ per Kg chromium metal, at a temperature of about 1200° C. to about 1600° C., for a period of about 2 hours to about 10 hours;

treating said hydrogen treated compacted body in a vacuum at a pressure less than or equal to about 100 $\mu$m of Hg (15 Pa), at a temperature of about 1200° C. to about 1600° C., for a period of time of about 2 hours to about 60 hours; and cooling and recovering a purified chromium metal.

17. The process of claim 10 wherein the pressure during compacting is about 80,000 psi ($55\times10^7$ Pa), and the critical diffusion dimension of the compacted body is less than or equal to about 22 mm.

18. The process of claim 16 wherein the hydrogen treatment is conducted at about 1500° C., for about 4 to about 6 hours with about 2.6 $m^3$ per Kg chromium metal of hydrogen gas.

19. The process of claim 16 wherein the vacuum treatment is conducted at about 1400° C., for about 4 to about 6 hours at less than or equal to about 10 $\mu$m of Hg (15 Pa).

20. A process for purifying a chromium metal obtained from an electrolytic, aluminothermic, or a pyrometallurgical reduction process comprising:

compacting a chromium metal powder without additives in a pelletizer at a pressure greater than or equal to about 50,000 psi ($50\times10^7$ Pa) to form a compacted body having a critical diffusion dimension less than or equal to about 25 mm;

heating said compacted body to a temperature of about 1200° C. to about 1600° C.;

treating said compacted body with hydrogen gas in an amount greater than or equal to about 0.8 $m^3$ per Kg chromium metal, while maintaining said compacted body at a temperature of about 1200° C. to about 1600° C. for a period of about 2 hours to about 10 hours;

treating said hydrogen treated compacted body in a vacuum at a pressure less than or equal to about 100 $\mu$m of Hg (15 Pa), while maintaining said compacted body at a temperature of about 1200° C. to about 1600° C. for a period of time of about 2 hours to about 60 hours; and cooling and recovering a purified chromium metal.

* * * * *